US008205401B2

(12) United States Patent
Ward

(10) Patent No.: US 8,205,401 B2
(45) Date of Patent: Jun. 26, 2012

(54) ROOF VENT AND SYSTEM

(76) Inventor: John F. Ward, Midhurst (CA)

( * ) Notice: Subject to any disclaimer, the term of this patent is extended or adjusted under 35 U.S.C. 154(b) by 202 days.

(21) Appl. No.: 12/722,750

(22) Filed: Mar. 12, 2010

(65) Prior Publication Data

US 2010/0257798 A1 Oct. 14, 2010

Related U.S. Application Data

(60) Provisional application No. 61/159,927, filed on Mar. 13, 2009, provisional application No. 61/267,891, filed on Dec. 9, 2009.

(51) Int. Cl.
*E04B 1/70* (2006.01)

(52) U.S. Cl. ..... 52/198; 52/97; 52/199; 52/302.1; 454/367

(58) Field of Classification Search ..... 52/198–200, 52/301, 97, 302.3, 302.1, 302.5, 302.7; 454/364–368, 242, 250, 339, 129, 356, 358, 454/359

See application file for complete search history.

(56) References Cited

U.S. PATENT DOCUMENTS

| | | | | |
|---|---|---|---|---|
| 2,214,183 | A | | 9/1940 | Seymour |
| 2,628,552 | A | | 2/1951 | Jones et al. |
| 2,799,214 | A | | 7/1957 | Roose |
| 2,868,104 | A | | 1/1959 | Honholt et al. |
| 3,326,170 | A | | 6/1967 | Lewery |
| 3,481,263 | A | | 12/1969 | Belden |
| 3,625,134 | A | | 12/1971 | Smith |
| 3,660,955 | A | | 5/1972 | Simon |
| 3,949,657 | A | | 4/1976 | Sells |
| 4,073,106 | A | | 2/1978 | Malott |
| 4,080,083 | A | | 3/1978 | Malott |
| 4,280,399 | A | | 7/1981 | Cunning |
| 4,325,290 | A | | 4/1982 | Wolfert |
| 4,484,424 | A | | 11/1984 | Logsdon |
| 4,520,713 | A | | 6/1985 | Arfsten |
| 4,550,648 | A | | 11/1985 | Eagle |
| 4,554,862 | A | | 11/1985 | Wolfert |
| 4,555,982 | A | | 12/1985 | Goubaud |
| 4,924,761 | A | | 5/1990 | MacLeod et al. |
| 5,402,611 | A | | 4/1995 | Vagedes |
| 5,425,672 | A | | 6/1995 | Rotter |
| 5,561,952 | A | | 10/1996 | Damron |
| 5,561,953 | A | | 10/1996 | Rotter |
| 5,591,080 | A | | 1/1997 | Ward |
| 5,662,522 | A | * | 9/1997 | Waltz ..... 454/359 |
| 5,664,375 | A | | 9/1997 | Ward |
| 5,791,985 | A | * | 8/1998 | Schiedegger et al. ..... 454/339 |
| 6,149,516 | A | | 11/2000 | Mantyla |

(Continued)

*Primary Examiner* — Basil Katcheves
*Assistant Examiner* — Beth Stephan
(74) *Attorney, Agent, or Firm* — Dickinson Wright PLLC

(57) ABSTRACT

Disclosed is a cover for a tubular duct extending from a planar roof surface. The cover comprises a cap, a skirt and a closure. In use: the cap is disposed outwardly from said duct, to define a headspace outside said duct and an annular space surrounding the headspace; the skirt extends from the rim of the cap in surrounding, spaced relation to said duct; and the closure extends from the terminus of the skirt to said duct and is disposed in spaced relation to said surface. The skirt and closure have vanes formed therein. The vanes are oriented such that: precipitation driven by wind through the skirt into the interior of the cap is directed, as it passes through the skirt, towards the roof; and precipitation driven by wind through the closure into the interior of the cap is directed, as it passes through the closure, away from the duct.

16 Claims, 17 Drawing Sheets

U.S. PATENT DOCUMENTS

| | | | | |
|---|---|---|---|---|
| 6,155,008 | A * | 12/2000 | McKee | 52/198 |
| 6,293,862 | B1 | 9/2001 | Jafine et al. | |
| 6,299,528 | B1 | 10/2001 | Hansen | |
| 6,302,787 | B1 | 10/2001 | Graft, Jr. | |
| 6,343,985 | B1 | 2/2002 | Smith | |
| 6,402,609 | B1 * | 6/2002 | Mangia | 454/18 |
| 6,520,852 | B2 | 2/2003 | McKee et al. | |
| 6,612,924 | B1 | 9/2003 | Mantyla et al. | |
| 6,767,281 | B2 * | 7/2004 | McKee | 454/367 |
| 6,902,476 | B2 | 6/2005 | Rotter | |
| 6,981,916 | B2 | 1/2006 | Coulton | |
| 7,182,688 | B2 | 2/2007 | Coulton | |
| 7,219,473 | B2 | 5/2007 | Mantyla et al. | |
| 7,222,463 | B2 | 5/2007 | Rotter | |
| 7,393,273 | B2 | 7/2008 | Ehrman et al. | |
| 2003/0054754 | A1 | 3/2003 | McKee | |
| 2003/0153262 | A1 * | 8/2003 | Mantyla et al. | 454/367 |
| 2005/0055920 | A1 * | 3/2005 | Lajewski | 52/302.1 |
| 2005/0126088 | A1 | 6/2005 | Rotter | |
| 2005/0148295 | A1 * | 7/2005 | Koessler | 454/353 |
| 2006/0096189 | A1 | 5/2006 | Pavlansky et al. | |
| 2007/0094953 | A1 | 5/2007 | Galeazzo et al. | |
| 2007/0141975 | A1 * | 6/2007 | Polston | 454/365 |
| 2007/0204532 | A1 | 9/2007 | McKee | |
| 2008/0034685 | A1 | 2/2008 | Ogletree | |
| 2009/0049769 | A1 | 2/2009 | Kaseda | |
| 2009/0053990 | A1 | 2/2009 | McKee | |

* cited by examiner

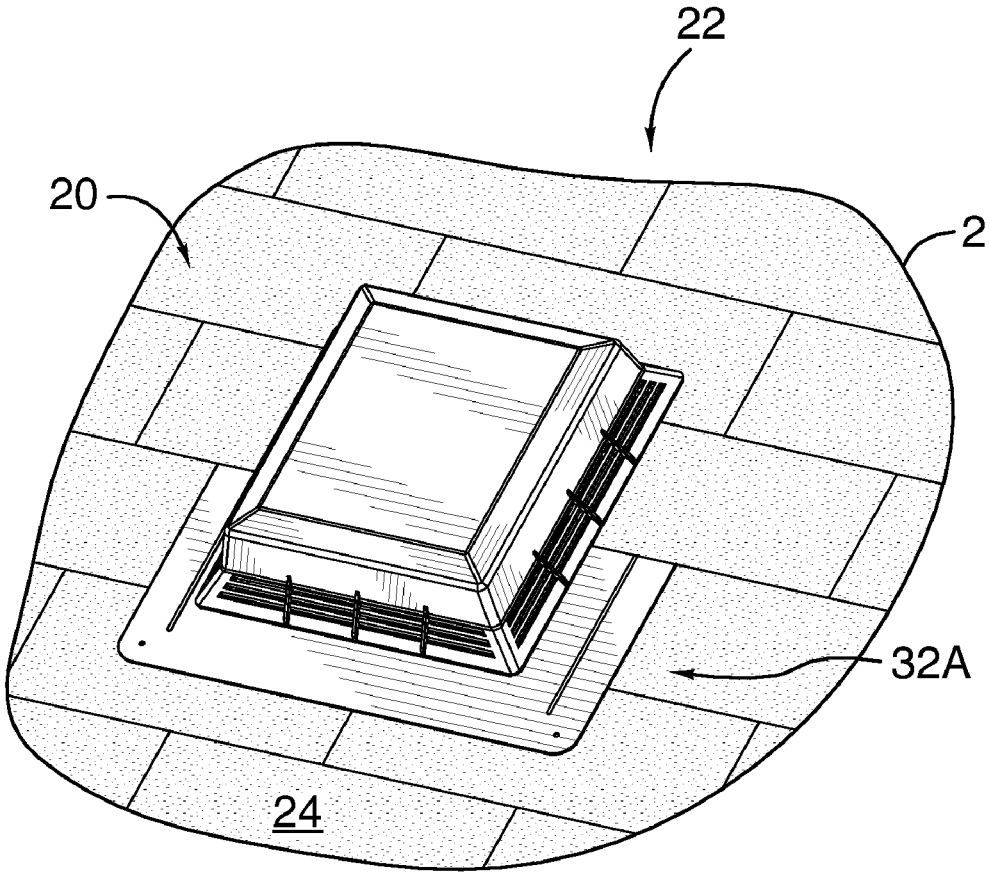
FIG.1.1

ROOF VENT AND SYSTEM

CROSS-REFERENCE TO RELATED APPLICATIONS

This application is related to, and claims the benefit of priority from, U.S. Provisional Application Ser. No. 61/159,927, filed Mar. 13, 2009, and U.S. Provisional Application Ser. No. 61/267,891, filed Dec. 9, 2009, the disclosures of which is incorporated herein by reference in their entireties.

FIELD OF THE INVENTION

The present invention relates to the field of roof ventilation.

BACKGROUND OF THE INVENTION

Most occupied buildings require venting. The type of venting employed depends on the kind of enclosure to be vented. For example, bathrooms containing showers typically have active vents with fans to vent steam outside. Other types of enclosures, such as attics, include a passive vent to allow for air flow from the enclosure to the atmosphere, to prevent moisture build-up. It is advantageous if the vent allows for the flow of air through the passage, without permitting moisture, such as rain or snow, to enter the enclosure through the passage. Structures are known that achieve this goal, but they can be relatively costly.

SUMMARY OF THE INVENTION

Forming one aspect of the invention is a cover for a tubular duct extending outwardly from a planar roof surface. This cover comprises a cap portion, a peripheral outer skirt and a closure element. The cap portion is disposed, in use, in outwardly spaced relation to said tubular duct, to define a headspace outside said tubular duct and an annular space surrounding the headspace. The peripheral outer skirt extends in use from the rim of the cap portion in surrounding, spaced relation to said duct. The closure element extends in use from the terminus of the outer skirt to said duct and is disposed in spaced relation to said roof surface. The peripheral outer skirt and the closure element have vanes formed therein, the vanes being oriented such that: precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the duct.

According to other aspects of the invention: the closure element can include an annular bottom portion which extends to the terminus of the outer skirt and an inner skirt which extends in use from the duct to the inner periphery of the annular bottom portion; and the outer skirt can flare outwardly as it extends from the rim of the cap portion and the inner skirt flares outwardly as it extends to the annular bottom portion.

According to another aspect of the invention, the annular bottom portion of the closure element can be substantially planar and orientated substantially parallel to said roof surface in use.

According to another aspect of the invention, the vanes on the outer skirt can define air passages which are orientated substantially normally to the roof surface in use.

According to another aspect of the invention, the vanes on the annular bottom portion and on the inner skirt can define air passages which are orientated at approximately 60° to the roof surface in use.

According to other aspects of the invention: the cap portion, in plan view, can take the shape of a polygon selected from the group consisting of triangle, square, rectangle, pentagon, hexagon, heptagon and octagon; the cap portion can be molded, with the closure element, as a single piece of plastic, with the closure element being defined by a plurality of screen segments provided one for each side of said polygon, each segment extending from a respective side of the outer skirt and joined thereto along a respective fold line; and, in manufacture of the cap portion, the screen segments can be pivoted about the fold lines into position.

According to another aspect of the invention, the cap portion can include a plurality of studs to which the segments are snap-fitted during assembly of the cap portion.

According to other aspects of the invention: the polygon can be a rectangle; one of the sides of the outer skirt can be imperforate and the other three sides and the closure element can be substantially entirely defined by vanes; and, in use, the cover can be mounted with the one side of the skirt defining the top of the skirt and the other three sides of the outer skirt defining the bottom and sides of the outer skirt.

According to another aspect of the invention, the cover can form part of a roof vent which comprises, in addition to the cover, a base member. This roof vent is for use with a roof having an aperture formed in a surface thereof. The base member includes: a tubular part disposed atop said roof surface in use to lead into said aperture; and a substantially planar part extending peripherally around and from said tubular part and sealingly mounted in use to said roof surface to seal the tubular part to said roof; and The tubular part of the base member defines the tubular duct with which the cover is used.

According to another aspect of the invention, the base member can have, for each stud of the cap portion, a receiver, to which said each stud is engaged in snap-fit relation in use, to secure the cover to the base member.

According to another aspect of the invention, the tubular part of the base member can be a tube of rectangular cross-section.

According to another aspect of the invention, the roof vent can form part of a roof vent assembly, for use with a roof having an aperture formed in a surface thereof, the roof further having a pipe stack protruding at least toward said aperture. In addition to said roof vent, this roof vent assembly comprises an adapter. The adapter includes a body and a flapper. The body is disposed in use in snap-fit engagement with the base member to define a conduit leading through the tubular part, the conduit being adapted to receive said pipe stack. The flapper is operatively mounted to the body to allow said pipe stack to vent to atmosphere through the roof vent and to restrict flow through the conduit in the other direction.

The adapter itself forms another aspect of the invention.

According to another aspect of the invention, the body of the adapter can be adapted to receive, in snug-fitting relation, a 6" diameter vent tube.

According to another aspect of the invention, the roof vent assembly can further comprise a coupler which is received in snug-fitting relation by the body in use and which is adapted to receive, in snug-fitting relation, a 4" diameter vent tube.

The coupler itself can form another aspect of the invention.

According to another aspect of the invention: the body can include a planar structure which is orientated substantially coplanar with the planar part of the base member and occludes the end of the tubular part. As well, the snap-fit engagement can be provided by: one or more spring fingers which extend from the planar structure into and beyond the tubular part of the base member in use, the spring fingers being resiliently compressible, to enable the body to be fitted into the base member, and having detents which engage the lip of the tubular part at the operative position of the body; and backer flanges, which extend from the planar structure in substantially coplanar relation thereto and, in use, in overlying relation to the planar part of the base member, to lock the adapter in the operative position thereof in combination with the spring fingers.

A roof vent system forms yet another aspect of the invention. This system comprises base members, covers, adapter and covers.

Each base member includes: a tubular part disposed in use atop a roof surface to lead into an aperture defined in said roof surface; and a substantially planar part extending peripherally around and from said tubular part and sealingly mounted in use to said roof surface to seal the tubular part to said roof.

Each cover has: a cap portion disposed, in use, in outwardly spaced relation to a tubular part of a base member, to define a headspace outside said tubular part and an annular space surrounding the headspace; a peripheral outer skirt extending in use from the rim of the cap portion in surrounding, spaced relation to said tubular part; and a closure element which extends in use from the terminus of the outer skirt to said tubular part and is disposed in spaced relation to said roof surface. The peripheral outer skirt and the closure element have vanes formed therein, the vanes being oriented such that: precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the tubular part.

Each adapter includes: a body disposed in use in snap-fit engagement with a respective base member to define a conduit leading through the tubular part of the base member; and a flapper operatively mounted to the body to define a flapper valve which allows flow to atmosphere and restricts opposing flow.

Each coupler has one end disposed, in use, in snug-fitting relation with a respective adapter body, and another end adapted to receive a stack.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter being briefly described hereinafter.

BRIEF DESCRIPTION OF THE DRAWINGS

FIG. 1.1 is a view of encircled structures 1.1 of FIG. 1A in use on a roof;

DETAILED DESCRIPTION

Figure 1:
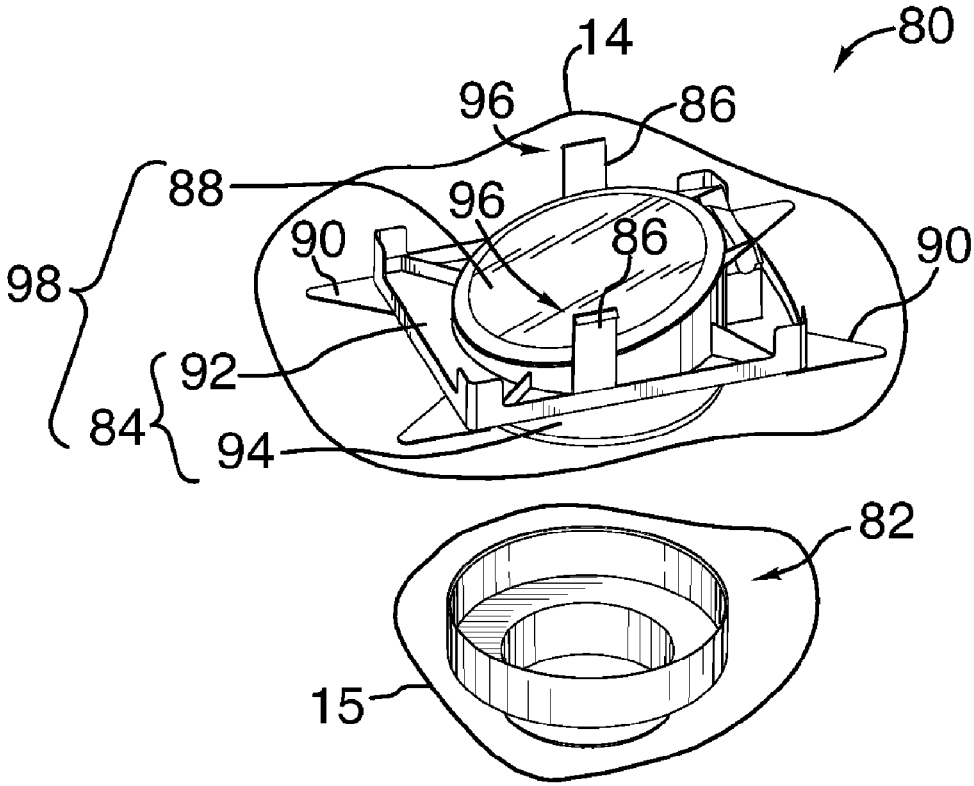
FIG. 1 and FIG. 1A are views of the components of a roof vent system which forms an exemplary embodiment of the invention.
Figure 1A:
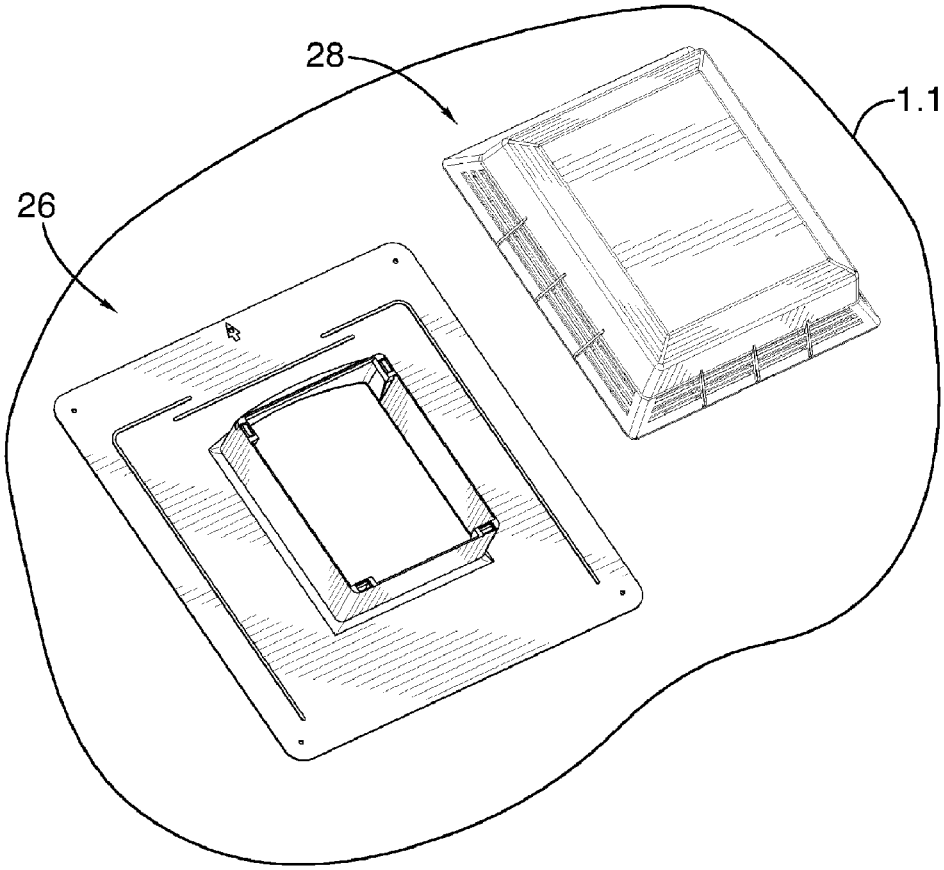

With general reference to FIG. 1 and FIG. 1A, the components of a roof vent system which form an exemplary embodiment of the present invention are shown and will be seen to include to include a base member 26, a cover 28, an adapter 80 and a coupler 82.

With regard to the base member 26 and cover 28, these are shown in FIG. 1.1 in use on a roof 22 having an aperture (not shown) formed in a surface 24 thereof, where they form a roof vent 20. The roof vent 20 is shown in isolation in FIG. 2

Figure 3:
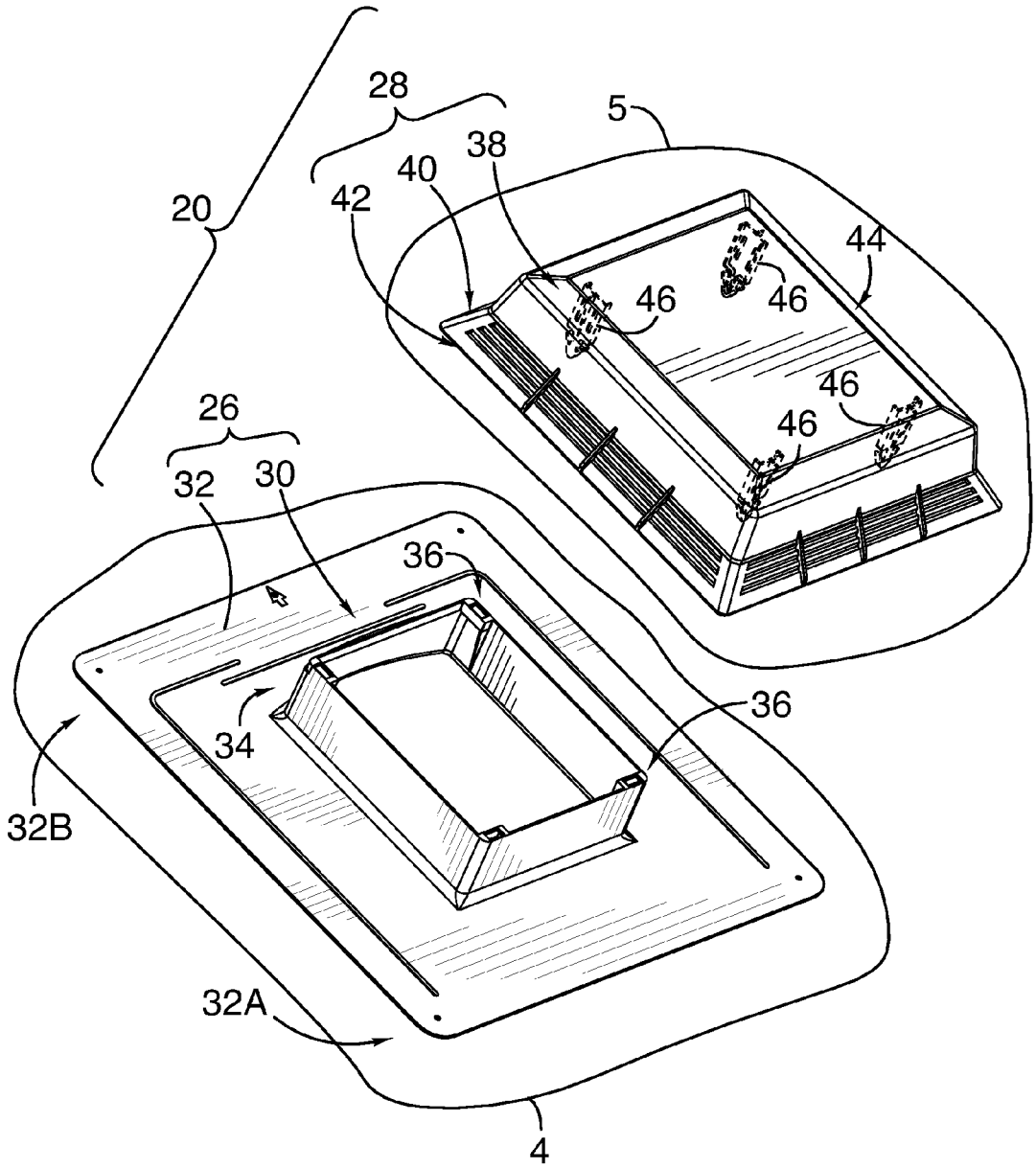
FIG. 3 is an exploded view of the structure of FIG. 2.
Figure 4:
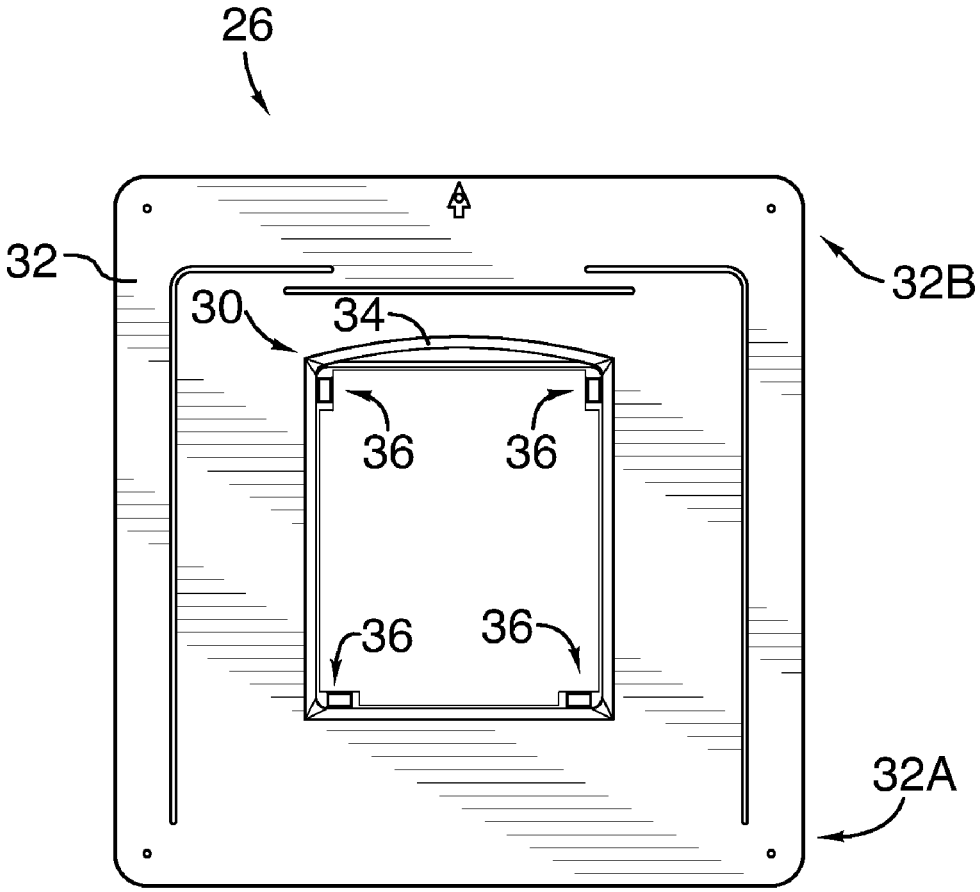
FIG. 4 is a top plan view of encircled area 4 in FIG. 3.

With reference to FIG. 3, the base member 26 includes a tubular part 30 and a planar part 32. As shown, these parts 30, 32 are formed integrally with one another, as a single injection-molded plastic component. The tubular part 30 is a tube of generally rectangular cross-section and is disposed atop said roof surface 24 in use to lead into the aperture (not shown) in the roof 22. One outer side 34 of the tube 30 defines a convex arch; when operatively mounted, this side 34 of the tube 30 is orientated to present upwardly, such that water can flow smoothly around the arch.

Adjacent each corner of the tube 30 is a receiver 36. The receiver 36 is described fully below. The planar part 32 extends peripherally around and from said tubular part 30 and is sealingly mounted to said roof surface 24 to seal the tubular part 30 to said roof 22. The planar part 32 is sealed to the roof 22 in a conventional manner, as shown in FIG. 1.1, wherein the lower portion 32A of the planar part 32 is disposed in overlying relation on a lower row of shingles, and upper rows of shingles are disposed in overlying relation on the upper portion 32B of the planar part 32, so as to ensure that water does not infiltrate beneath the planar part 32. Sealant or caulking products, such as tar or glue, can also be used.

The cover 28 comprises a cap portion 38, a peripheral outer skirt 40 and a closure element 42.

Figure 7:
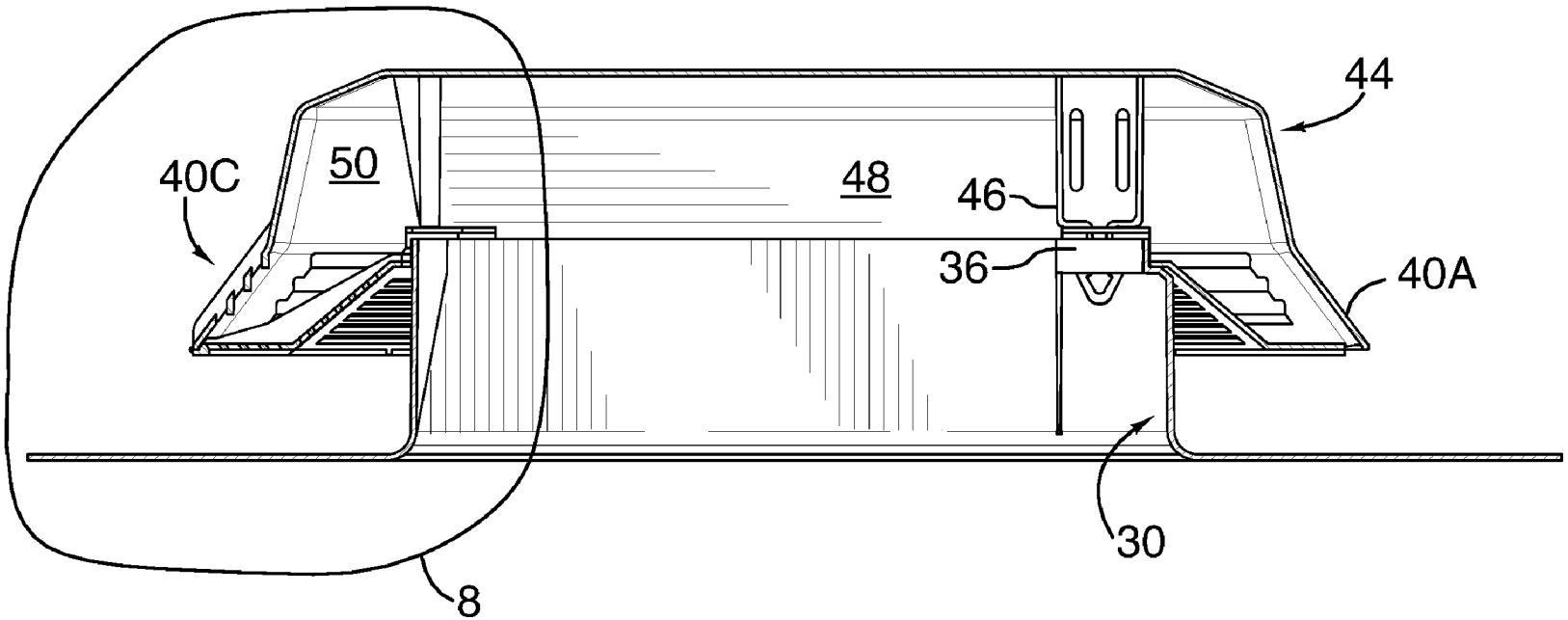
FIG. 7 is a view along 7-7 of FIG. 6.

Cap portion 38 includes a body 44 which is polygonal, specifically, rectangular in shape in plan, and also includes, for each receiver, a stud 46, shown in phantom in FIG. 3. In use, each stud 46 is disposed in snap-fit secure engagement with the receiver 36 for which it is provided (not shown). With reference to FIG. 7, this holds the body 44 in outwardly spaced relation to said tubular duct 30, to define a headspace 48 outside said tubular duct 30 and an annular space 50 surrounding the headspace 48. The studs 46 will be seen to take two orientations, and the receivers 30 are shaped in a complementary manner; this ensures that the body 44 can be snap-fit to the base member 26 in only one orientation.

The outer skirt 40 extends in use from the rim 52 of the cap portion 38 in surrounding, spaced relation to said duct 30, and flares outwardly as it so extends.

The closure element 42 is disposed in spaced relation to the planar part 32/roof surface 24 in use and includes an annular bottom portion 54 and an inner skirt 56. The bottom portion 54 is substantially planar and orientated substantially parallel to said roof surface 24/planar part 32 in use and extends to the terminus 58 of outer skirt 40.

The inner skirt 56 extends in use from the duct 30 to the inner periphery 60 of the annular bottom portion 54 and flares outwardly as it so extends.

Vanes 62 are defined in the outer skirt 40 and in the closure element 42. More particularly, one of the sides 40A of the outer skirt 40 is imperforate and the other three sides 40B, 40C,40D of the outer skirt 40 and the closure element 42 are substantially entirely defined by vanes 62; stiffening ribs 64 define the balance of these structures and securely hold the vanes 62 together.

In use, the one side 40A defines the top of the outer skirt 40 and the other three sides 40B,40C,40D define the bottom and sides of the outer skirt 40. With general reference to FIGS. 7,8, the vanes 62 on the outer skirt 40 define air passages 66 which are orientated substantially perpendicular to the roof surface 24 in use. The vanes 62 on the bottom portion 54 and on the inner skirt 56 define air passages 68 which are orientated at approximately 60° to the roof surface 24 in use.

Figure 8:
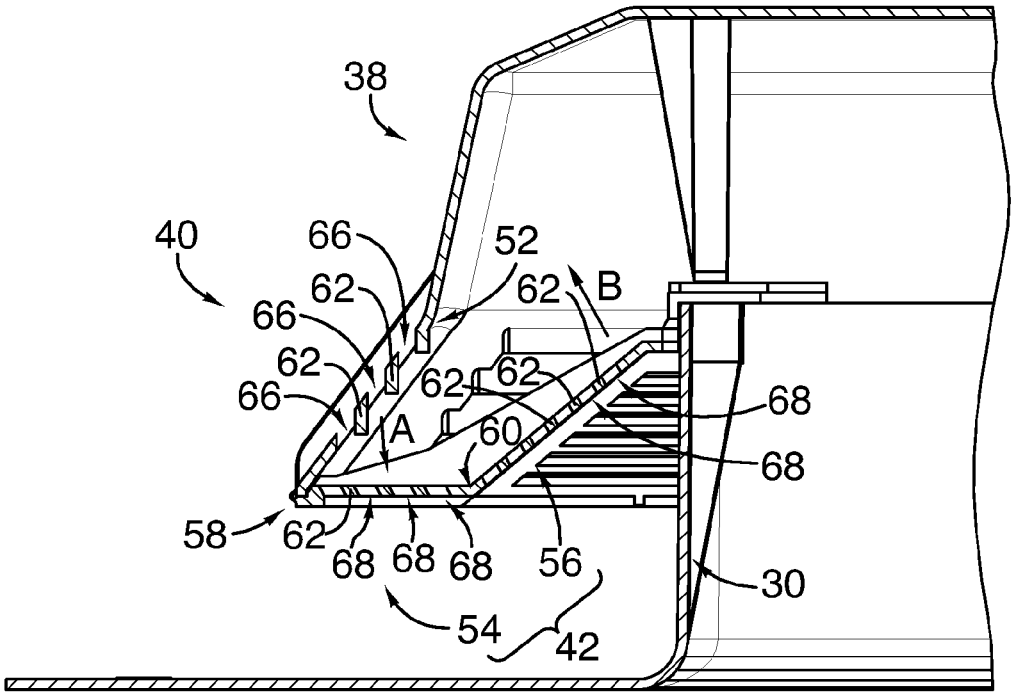
FIG. 8 is an enlarged view of encircled area 8 of FIG. 7.
Figure 9:
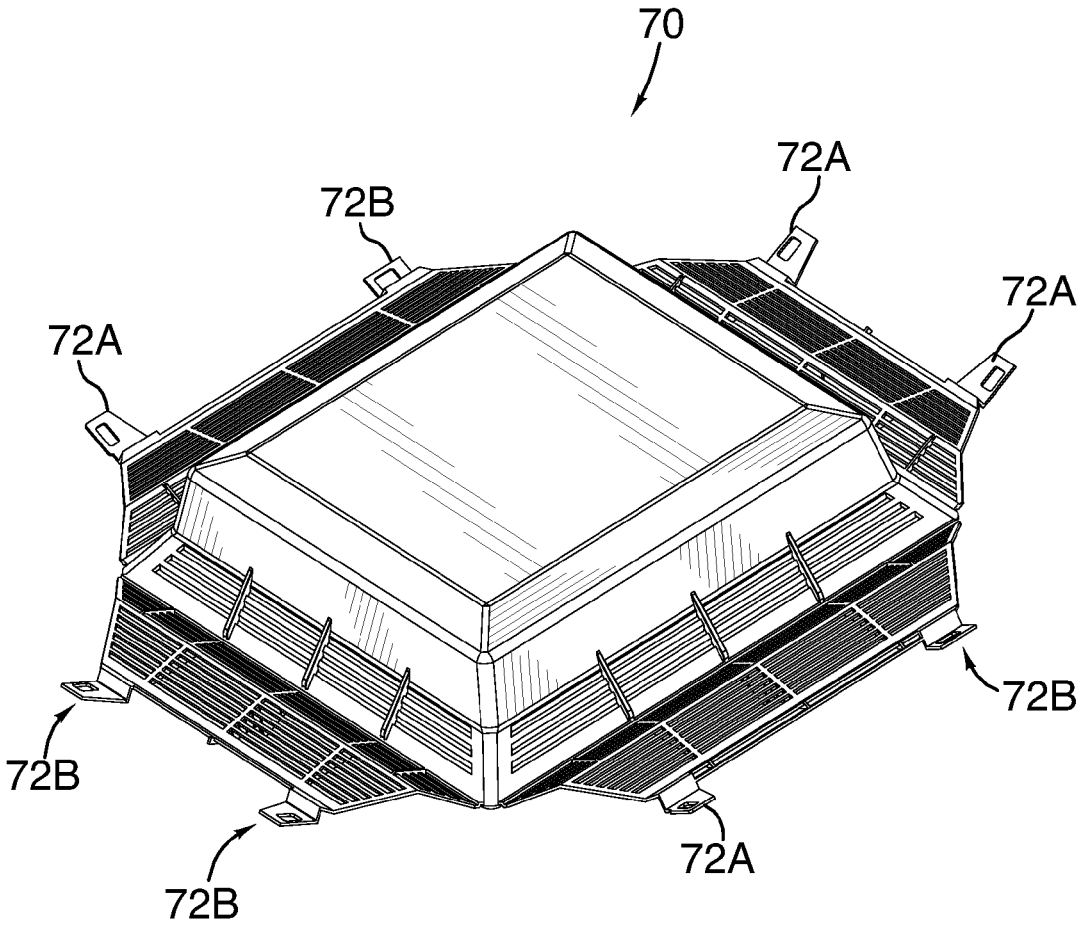
FIG. 9 is a top perspective view of a preform according to another exemplary embodiment of the invention.
Figure 10:
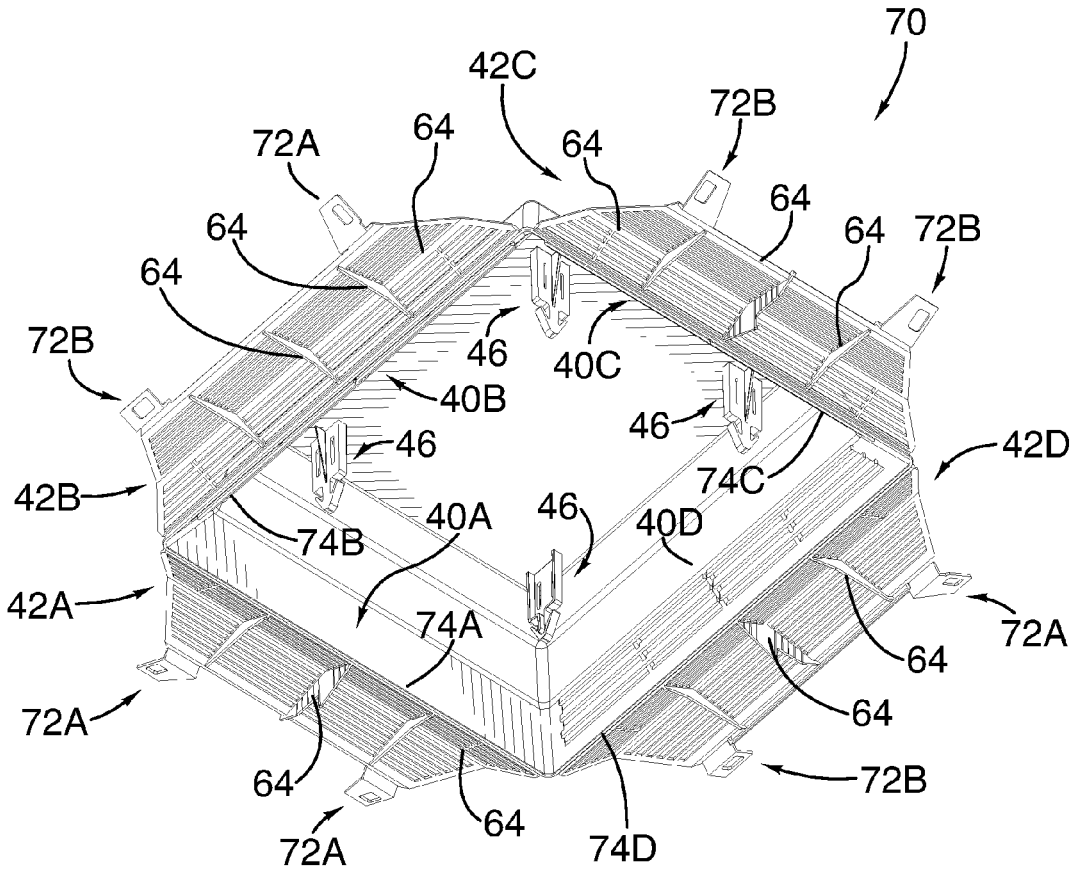
FIG. 10 is a bottom perspective view of the structure of FIG. 9.
Figure 11:
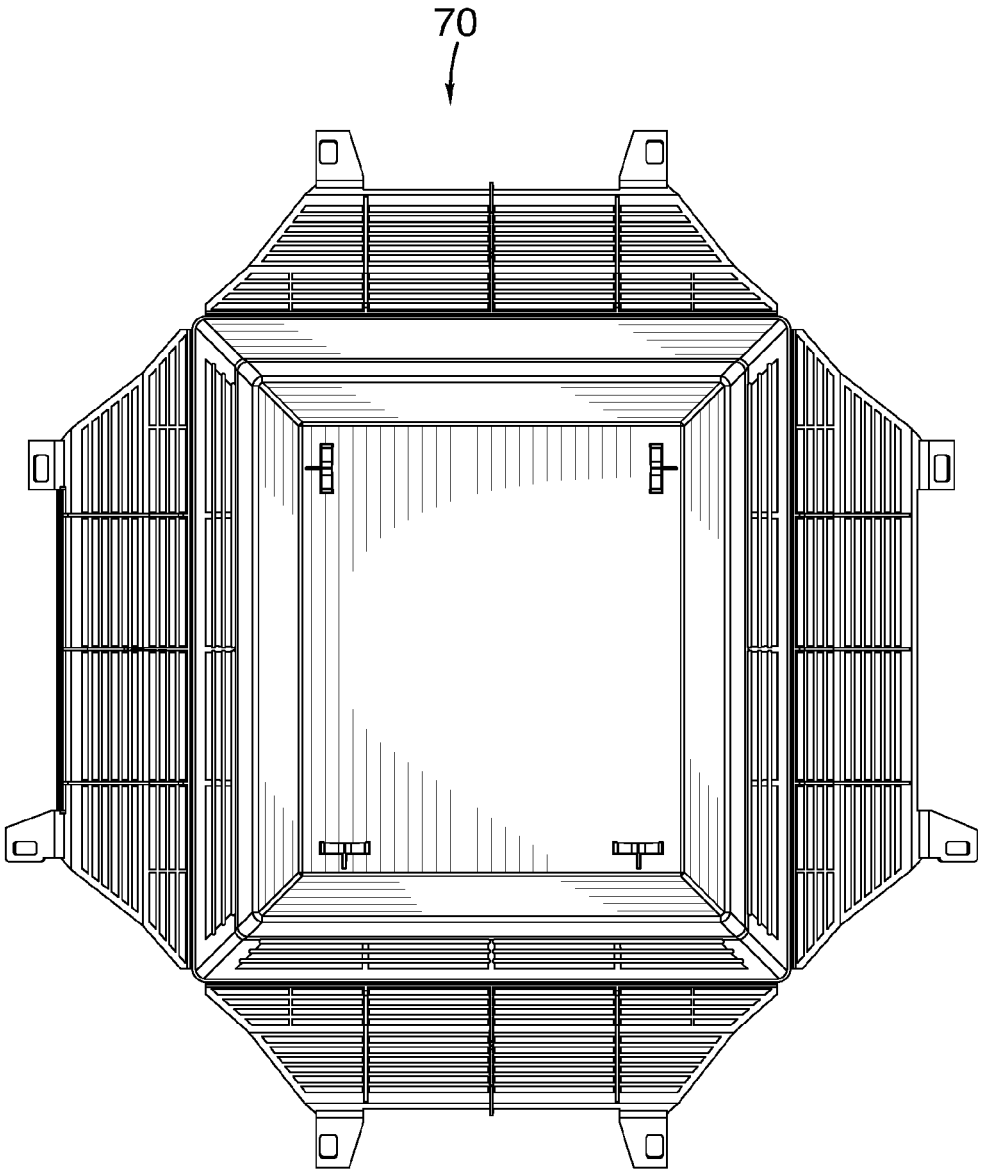
FIG. 11 is a bottom plan view of the structure of FIG. 9.
Figure 12:
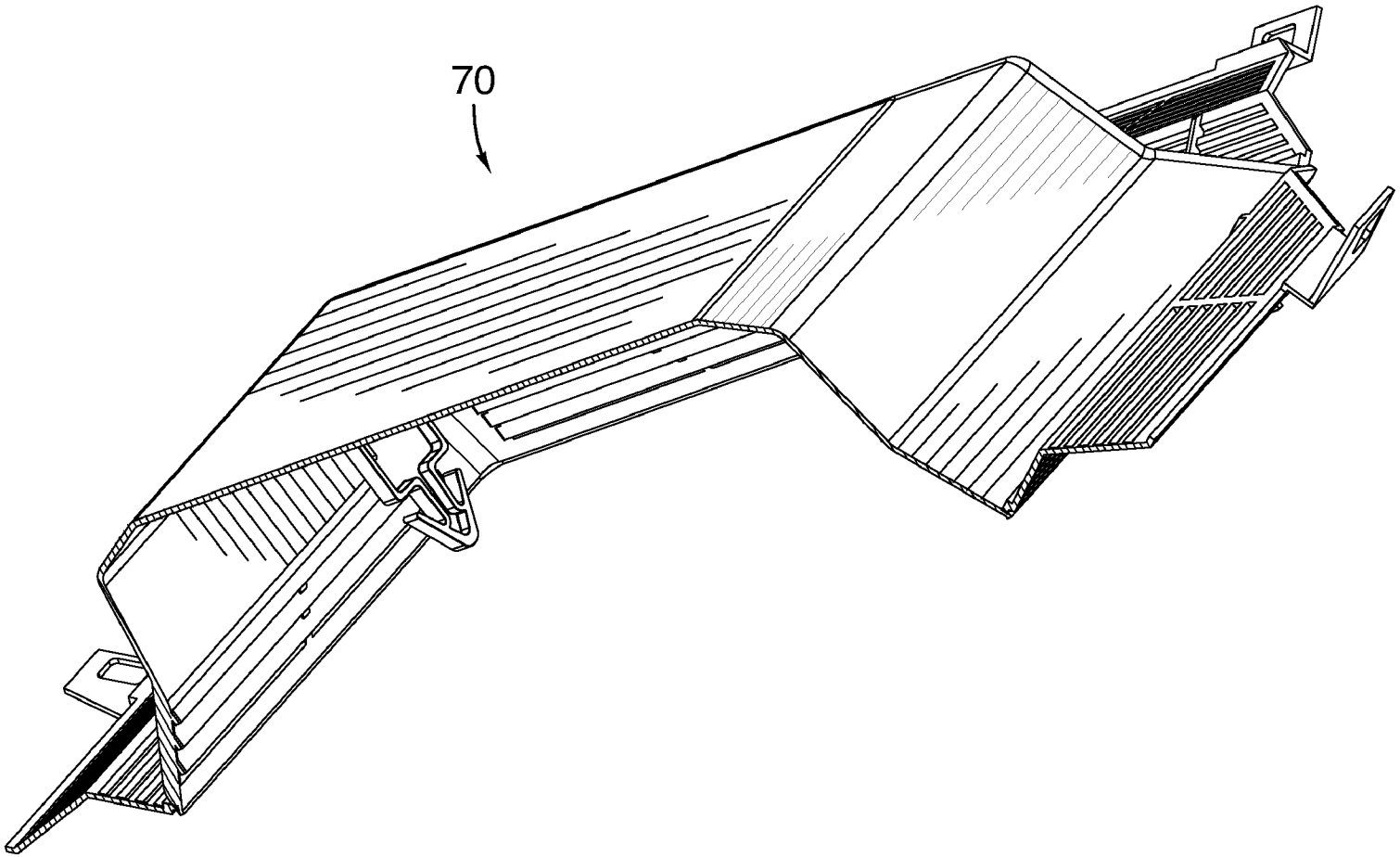
FIG. 12 is a partial sectional perspective view of the structure of FIG. 9.
Figure 13:
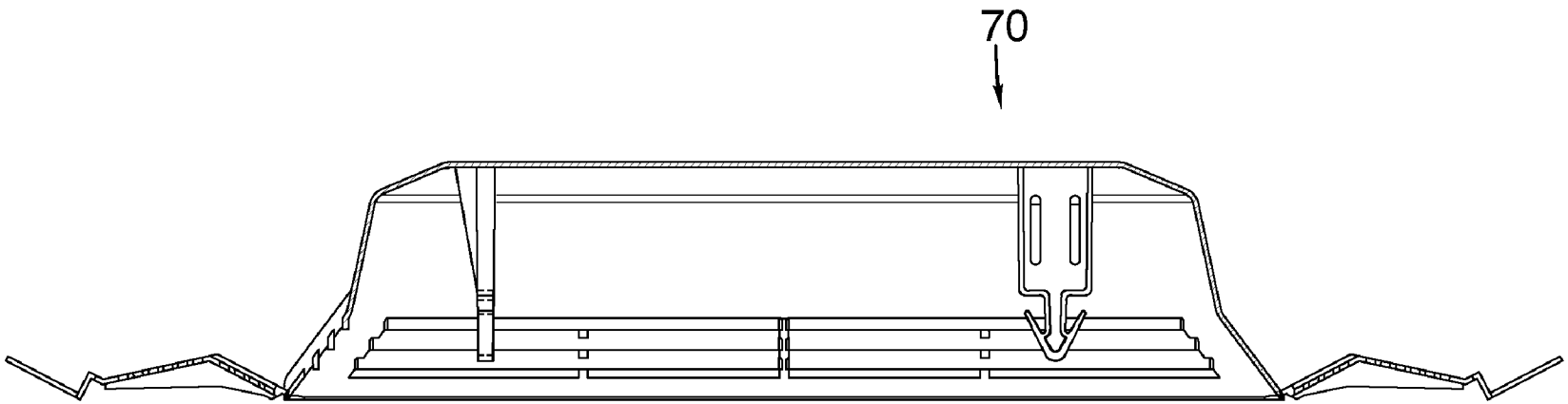
FIG. 13 is a side view of the structure of FIG. 9.

This orientation is such that: precipitation driven by wind through outer skirt 40 into the interior of the cap 38 is directed, as it passes through the outer skirt 40, downwardly towards the roof 22, as indicated by arrow A in FIG. 8; and precipitation driven by wind through the closure element 42 into the interior of the cap portion 38 is directed, as it passes through the closure element 42, away from the duct, as indicated by arrow B in FIG. 8. In this description and in the appended claims, if a flow is indicated to be "directed" in a particular direction, this should not be understood as requiring that the resultant flow is in the particular direction, but only that the overall direction of the flow has at least been shifted towards the particular direction.

Without intending to be bound by theory, the combination of airflow towards the roof on the outer periphery of the cap, with the upward, radially outward airflow in the inner periphery, is believed to provides conditions conducive for an eddy flow to direct precipitation away from the duct notwithstanding that the vent itself may be employed in passive manner, i.e. with no fan positively driving airflow through the duct to the outside.

The one (top) side 40A of the outer skirt is substantially shielded from the wind, in that it faces generally towards the peak (not shown) of the roof 22. For this reason, there exists little likelihood of in-blown precipitation. The greatest risk of water infiltration in this region is through splashing, and for this reason, this side 40A of the outer skirt is made imperforate, to serve as an extended overhang.

Figure 5:
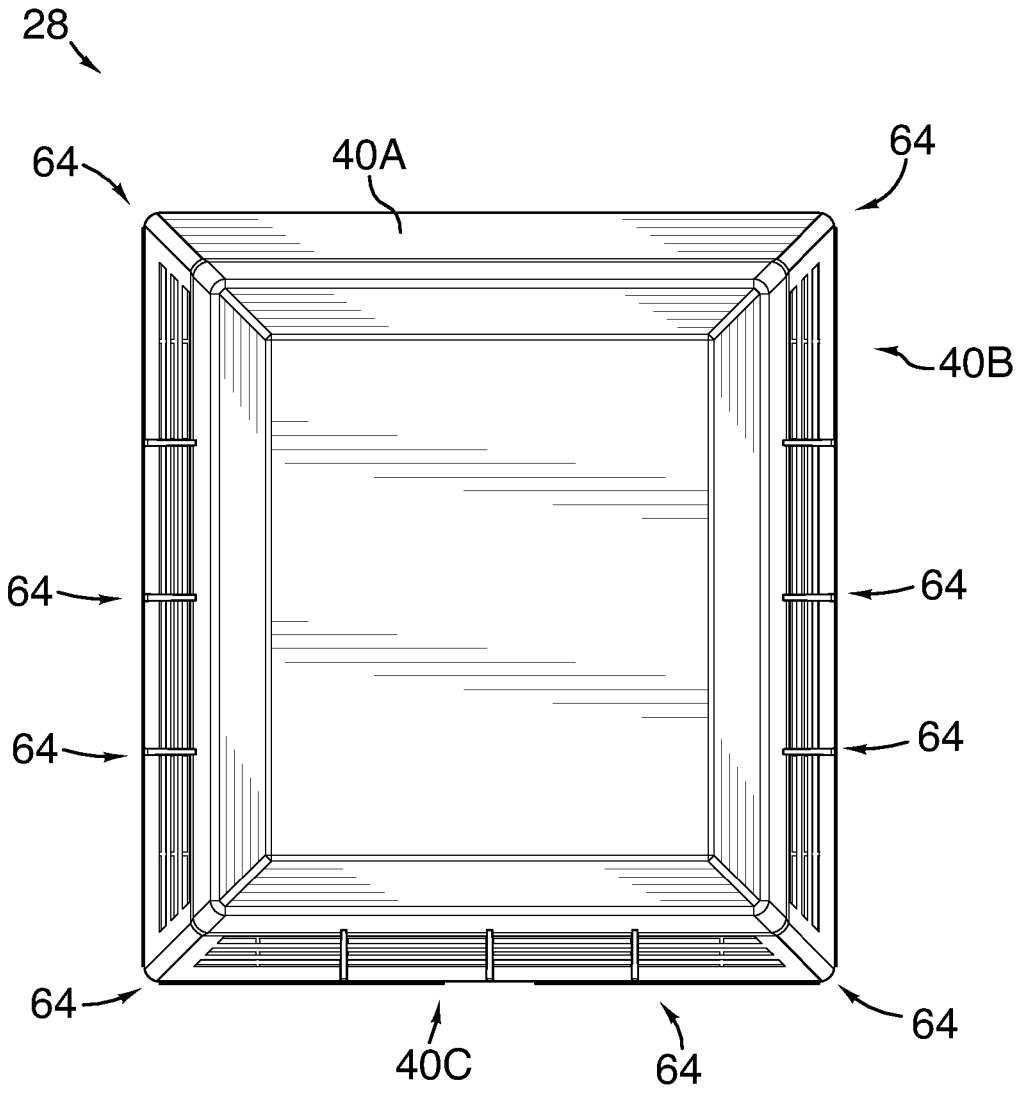
FIG. 5 is a top plan view of encircled area 5 in FIG. 3.
Figure 6:
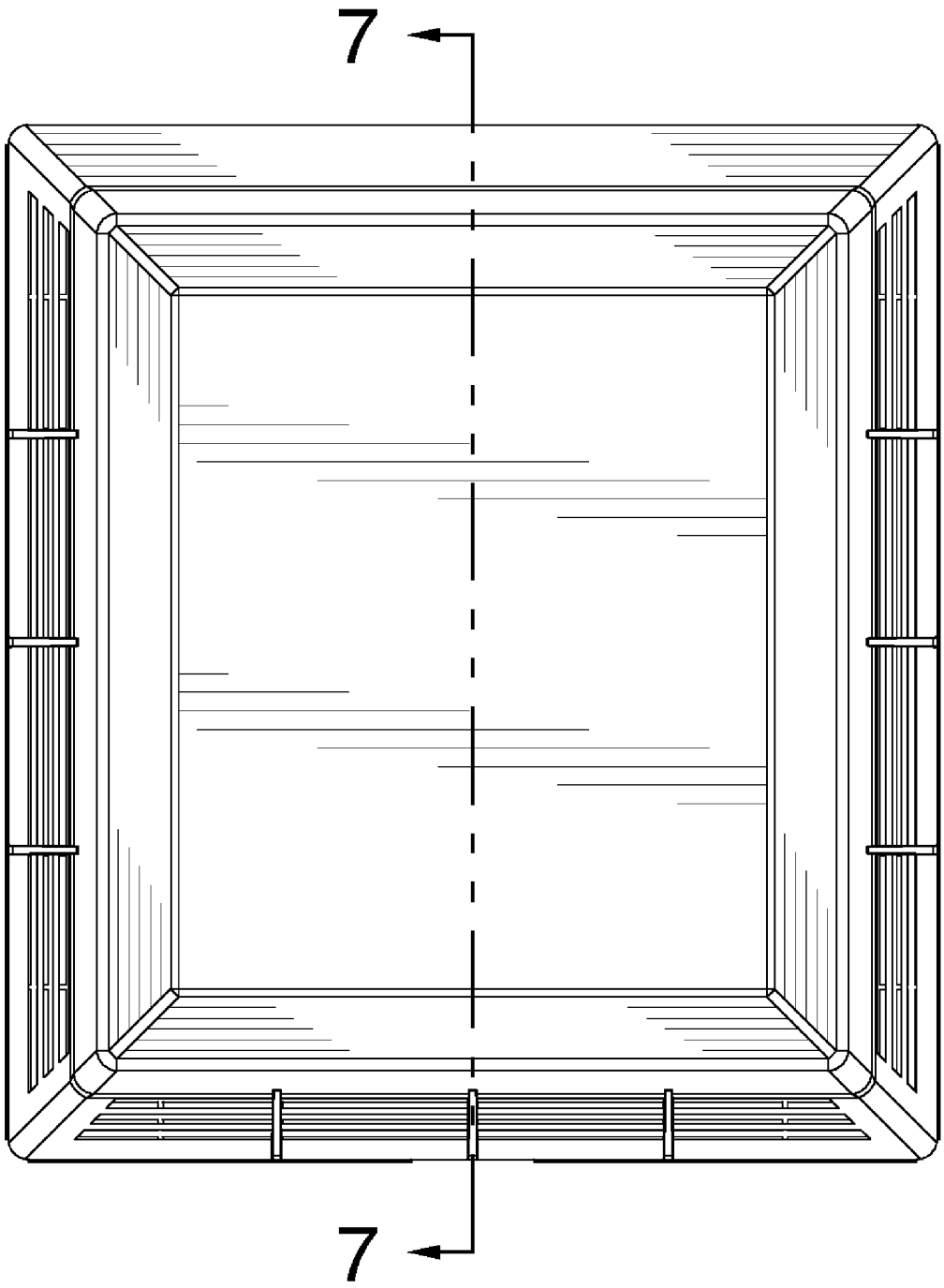
FIG. 6 is a partial plan view of the structure of FIG. 2.

FIGS. 9-13 show a preform 70, which forms another exemplary embodiment of the invention and is advantageously used to create the apparatus of FIG. 5. The preform 70 is an injection-molded piece which includes the cap portion, the outer skirt and the closure element, i.e. the cap portion, outer skirt and closure element are injection-molded as a single piece of plastic.

To allow for the preform 70 to be conveniently released from the mold (not shown) without the need for removable cores, etc., and to avoid the need for sonic welding or the like, the closure element is defined by a plurality of segments 42A,42B,42C,42D provided one for each side of said polygon/rectangle and each including a pair of flaps. The flaps take two forms 72A and 72B.

Each segment 42A,42B,42C,42D extends from a respective side 40A,40B,40C,40D of the outer skirt and is joined thereto along a respective fold zone hinge 74A,74B,74C,74D such that, in manufacture of the apparatus, the segments 42A,42B,42C,42D are pivoted about the fold zones 74A,74B, 74C,74D and snap-fit into position, by engagement of the flaps 72A and 72B into notches formed in studs 46. The different forms of flaps, i.e. 72A and 72B, allow for engagement with the notches notwithstanding the varied orientations of the studs 46.

Figure 14:
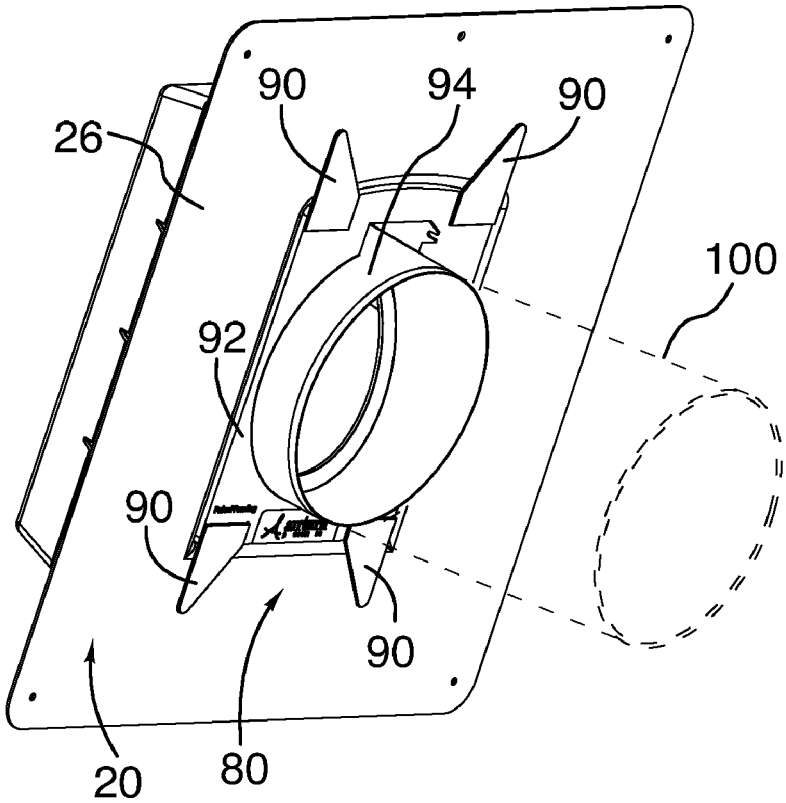
FIG. 14 is a view of the structure in encircled area 14 of FIG. 1A positioned for use with the structure of FIG. 2.
Figure 15:
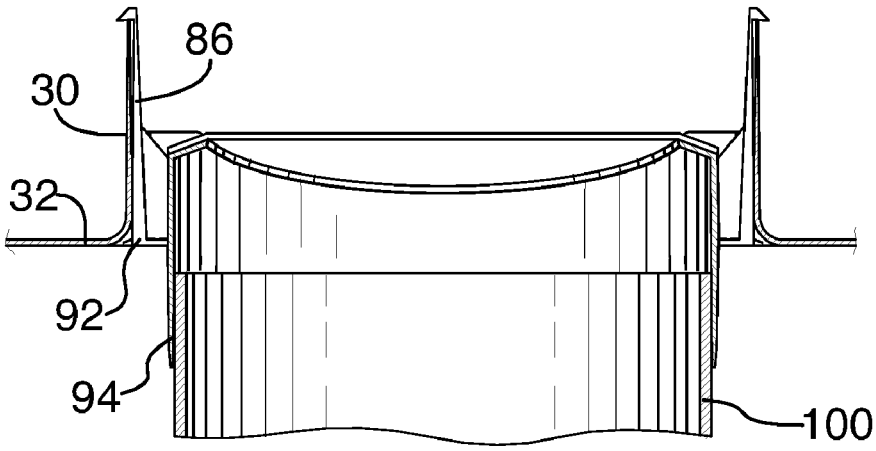
FIG. 15 is a partial sectional view of the structure of FIG. 14 in use.

Turning now to the adapter 80, this will be seen in FIG. 1 to include a body 84, spring fingers 86, a flapper 88 and backer flanges 90. The body 84 includes a planar structure 92 through which passes a conduit 94. The spring fingers 86 extend normally from the planar structure 92 and terminate in detents 96. The flapper 88 is mounted to the body 84 to define, in combination with the conduit 94, a flapper valve 98. The backer flanges 90 extend from the planar structure 92 in substantially coplanar relation thereto. This adapter 80 is used in combination with the roof vent 20 of FIG. 2 on roof structures wherein a pipe stack extends through the aperture. FIGS. 14 and 15 show the adapter 80 ready for use with the roof vent 20. In this position, planar structure 92 is orientated substantially coplanar with the planar part 32 of the base member 26 and occludes the end of the tubular part 30. The spring fingers 86 extend from the planar structure 92 into and beyond the tubular part 30 in use, and the detents 96 thereof engage the lip of the tubular part 30, to restrain the adapter 80 and vent 20 from moving apart from one another. The backer flanges 90, in turn, are disposed in overlying relation to the planar part 32 of the base member 26, to lock, in combination with the spring fingers 86, the adapter 80 in the operative position shown. As will readily be apparent to persons of ordinary skill in the art, the assembly operation (not shown), merely requires the spring fingers 86 to be compressed radially inwardly, for passage through the tubular part 30; at the operative position shown, the spring fingers 86, being resiliently compressible, spring back radially outwardly, thereby to provide a 'snap-fit" engagement.

Figure 2:
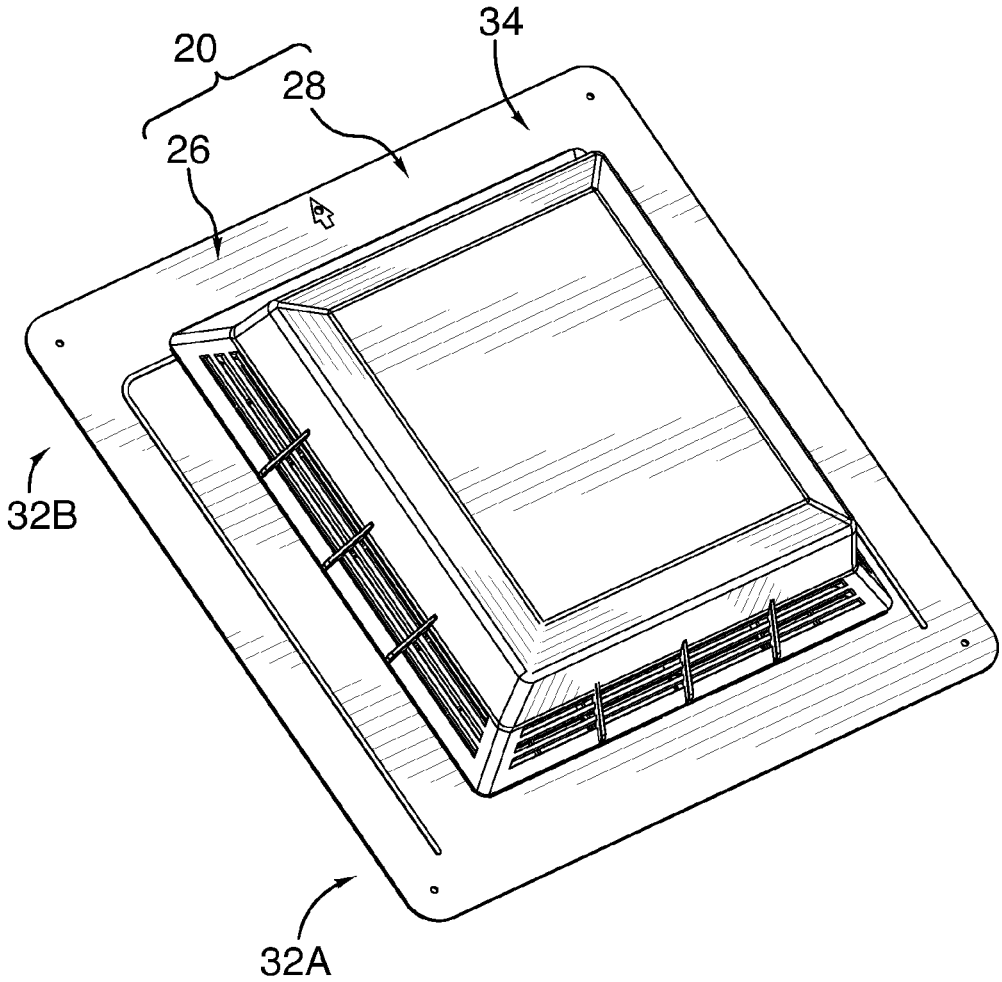
FIG. 2 is a view of encircled structure 2 of FIG. 1.1 from another vantage point.

This specific arrangement permits the roof vent 20 of FIG. 2 to be used in situations wherein a 6" pipe stack/vent protrudes through the roof aperture; the body 84, or more specifically the conduit 94, is adapted to receive, in snug-fitting relation, a 6" diameter vent tube 100, indicated in phantom in FIG. 14, such that the flapper 88 allows said pipe stack 100 to vent to atmosphere through the roof vent 20 and to restrict flow through the conduit 94 in the other direction.

Figure 16:
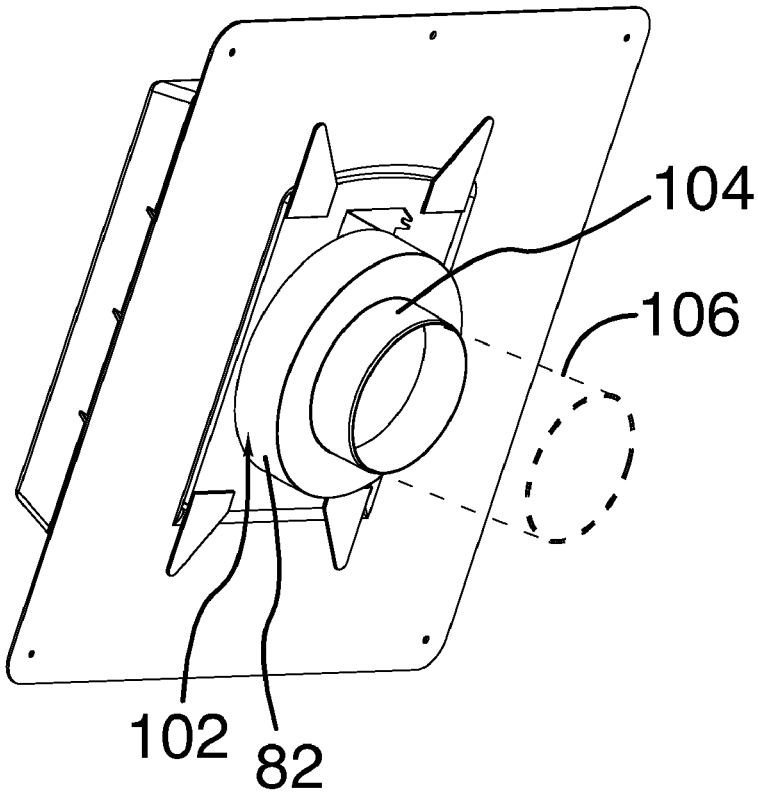
FIG. 16 is a view of the structure in encircled area 15 of FIG. 1A positioned for use with the structure of FIG. 14.
Figure 17:
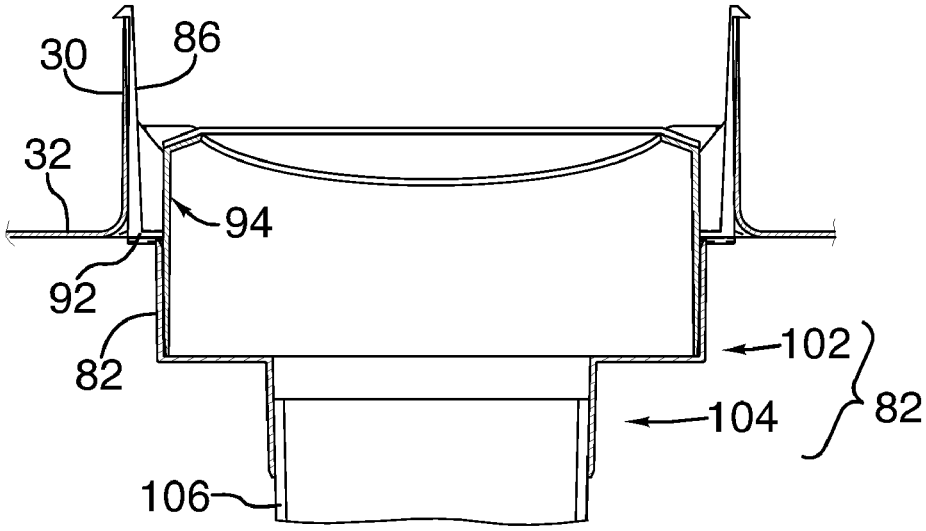
FIG. 17 is a partial sectional view of the structure of FIG. 16.

Turning now finally to the coupler 82 and with reference to FIGS. 16,17, this will be seen to include one end 102 which, in use, is received in snug-fitting relation by the body 84, and another end 104 which is adapted to receive, in snug-fitting relation, a 4" diameter vent tube 106 (shown in phantom in FIG. 16)

While but various embodiments of the present invention have been herein shown and described, it will be understood that various changes in size and shape of parts may be made.

Firstly, whereas the illustrated cap portion is generally in the shape of a rectangle, the cap portion, in plan view, can take other shapes, for example, any polygon selected from the group consisting of triangle, square, rectangle, pentagon, hexagon, heptagon and octagon.

Further, whereas the tubular part of the base is rectangular in cross-section, other shapes may be used.

As well, whereas the roof vent of the illustrated embodiment includes a base member which defines a duct with which the apparatus is used, it will be evident that the base member is not strictly necessary; the apparatus according to the exemplary embodiment could, for example, be employed with a rectangular duct that protruded through a roof and which was sealed, by example, by flashing and tar.

Further, whereas the skirt portion illustrated departs at a substantial angle from the body of the cap portion, other geometries are contemplated. As well, whereas the illustrated cap portion is substantially rectilinear, this is also not necessary; bowl-shaped cap portions could also be used.

Accordingly, it should be understood that invention is to be limited only by the claims appended hereto, purposively construed.

The invention claimed is:

1. A cover for a tubular duct extending from a planar roof surface, the cover comprising:

a cap portion disposed, in use, in spaced relation to said tubular duct, to define a headspace to which said tubular duct extends and an annular space surrounding the headspace;

a peripheral outer skirt extending in use from a rim of the cap portion in surrounding, spaced relation to said duct; and a closure element which extends in use from a terminus of the outer skirt to said duct and is disposed in spaced relation to said roof surface, the peripheral outer skirt and the closure element having vanes formed therein, the vanes being oriented such that:

precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the duct.

2. A cover according to claim 1, wherein:

the closure element includes: an annular bottom portion which extends to the terminus of the outer skirt; and an inner skirt which extends in use from the duct to the inner periphery of the annular bottom portion; and the outer skirt flares outwardly as it extends from the rim of the cap portion and the inner skirt flares outwardly as it extends to the annular bottom portion.

3. A cover according to claim 2, wherein the annular bottom portion of the closure element is substantially planar and orientated substantially parallel to said roof surface in use.

4. A cover according to claim 2, wherein the vanes on the outer skirt define air passages which are orientated substantially normally to the roof surface in use; and the vanes on the annular bottom portion and on the inner skirt define air passages which are orientated at approximately 60° to the roof surface in use.

5. A cover according to claim 1, wherein the cap portion, in plan view, takes the shape of a polygon selected from the group consisting of triangle, square, rectangle, pentagon, hexagon, heptagon and octagon;

the cap portion is molded, with the closure element, as a single piece of plastic, with the closure element being defined by a plurality of screen segments provided one for each side of said polygon, each segment extending from a respective side of the outer skirt and joined thereto along a respective fold line; and in manufacture of the cap portion, the screen segments are pivoted about the fold lines into position.

6. A cover according to claim 5, wherein the cap portion includes a plurality of studs to which the segments are snap-fitted during assembly of the cap portion.

7. A cover according to claim 5, wherein: the polygon is a rectangle; one of the sides of the outer skirt is imperforate; the other three sides of the outer skirt and the closure element are substantially entirely defined by vanes; and, in use, the cover is mounted with the one side of the skirt defining the top of the skirt and the other three sides of the outer skirt defining the bottom and sides of the outer skirt.

8. A roof vent, for use with a roof having an aperture formed in a surface thereof, said vent comprising:

a base member including:

a tubular part disposed atop said roof surface in use to lead into said aperture; and a substantially planar part extending peripherally around and from said tubular part and sealingly mounted in use to said roof surface to seal the tubular part to said roof; and the cover according to claim 6, arranged, in use, with the tubular part of the base member defining the tubular duct with which the cover is used.

9. A roof vent according to claim 8, wherein the base member has, for each stud of the cap portion, a receiver, to which each stud is engaged in snap-fit relation in use, to secure the cover to the base member.

10. A roof vent according to claim 8, wherein the tubular part of the base member is a tube of rectangular cross-section.

11. A roof vent, for use with a roof having an aperture formed in a surface thereof, said roof vent comprising:

a base member including:

a tubular part disposed atop said roof surface in use to lead into said aperture; and a substantially planar part extending peripherally around and from said tubular part and sealingly mounted in use to said roof surface to seal the tubular part to said roof; and a cover including:

a cap portion disposed, in use, in outwardly spaced relation to said tubular part, to define a headspace outside said tubular part and an annular space surrounding the headspace;

a peripheral outer skirt extending in use from a rim of the cap portion in surrounding, spaced relation to said duct; and a closure element which extends in use from the terminus of the outer skirt to said duct and is disposed in spaced relation to said roof surface, the peripheral outer skirt and the closure element having vanes formed therein, the vanes being oriented such that:

precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the duct; and wherein the cover is, arranged, in use, with the tubular part of the base member defining the duct with which the cover is used.

12. A roof vent assembly, for use with a roof having an aperture formed in a surface thereof, the roof further having a pipe stack protruding at least toward said aperture, said roof vent assembly comprising:

a base member including:

a tubular part disposed atop said roof surface in use to lead into said aperture; and a substantially planar part extending peripherally around and from said tubular part and sealingly mounted in use to said roof surface to seal the tubular part to said roof; and a cover including:

a cap portion disposed, in use, in outwardly spaced relation to said tubular part, to define a headspace outside said tubular part and an annular space surrounding the headspace;

a peripheral outer skirt extending in use from a rim of the cap portion in surrounding, spaced relation to said tubular part; and a closure element which extends in use from the terminus of the outer skirt to said tubular part and is disposed in spaced relation to said roof surface, the peripheral outer skirt and the closure element having vanes formed therein, the vanes being oriented such that:

precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the tubular part; and an adapter including:

a body disposed in use in snap-fit engagement with the base member to define a conduit leading through the tubular part, the conduit being adapted to receive the pipe stack; and a flapper operatively mounted to the body to allow the pipe stack to vent to atmosphere through the roof vent and to restrict flow through the conduit in the other direction.

13. The roof vent assembly of claim 12, wherein the body is adapted to receive, in snug-fitting relation, a 6" diameter vent tube.

14. The roof vent assembly of claim 13, further comprising a coupler which is received in snug-fitting relation by the body in use and which is adapted to receive, in snug-fitting relation, a 4" diameter vent tube.

15. A roof vent assembly according to claim 12, wherein the body includes a planar structure which is orientated substantially coplanar with the planar part of the base member and occludes the end of the tubular part;

the snap-fit engagement is provided by one or more spring fingers which extend from the planar structure into and beyond the tubular part of the base member in use, the spring fingers being resiliently compressible, to enable the body to be fitted into the base member, and having detents which engage the lip of the tubular part at the operative position of the body; and backer flanges, which extend from the planar structure in substantially coplanar relation thereto and, in use, in overlying relation to the planar part of the base member, to lock the adapter in the operative position thereof in combination with the spring fingers.

16. A roof vent system comprising:

base members, each base member including: a tubular part disposed in use atop a roof surface to lead into an aperture defined in said roof surface; and a substantially planar part extending peripherally around and from said tubular part and sealingly mounted in use to said roof surface to seal the tubular part to said roof;

covers, each cover having: a cap portion disposed, in use, in outwardly spaced relation to a tubular part of a base member, to define a headspace outside said tubular part and an annular space surrounding the headspace; a peripheral outer skirt extending in use from the rim of the cap portion in surrounding, spaced relation to said tubular part; and a closure element which extends in use from the terminus of the outer skirt to said tubular part and is disposed in spaced relation to said roof surface, the peripheral outer skirt and the closure element having vanes formed therein, the vanes being oriented such that:

precipitation driven by wind through the outer skirt into the interior of the cap portion is directed, as it passes through the outer skirt, towards the roof; and precipitation driven by wind through the closure element into the interior of the cap portion is directed, as it passes through the closure element, away from the tubular part;

adapters, each adapter including:

a body disposed in use in snap-fit engagement with a respective base member to define a conduit leading through the tubular part of the base member; and a flapper operatively mounted to the body to define a flapper valve which allows flow to atmosphere and restricts opposing flow; and couplers, each coupler having one end disposed, in use, in snug-fitting relation with a respective adapter body, and another end adapted to receive a stack.

* * * * *